US009186542B2

(12) United States Patent
Shen

(10) Patent No.: US 9,186,542 B2
(45) Date of Patent: Nov. 17, 2015

(54) TWISTING EXERCISER DEVICE

(71) Applicant: Yu Chen Shen, Changhua (TW)

(72) Inventor: Yu Chen Shen, Changhua (TW)

( * ) Notice: Subject to any disclaimer, the term of this patent is extended or adjusted under 35 U.S.C. 154(b) by 106 days.

(21) Appl. No.: 14/166,911

(22) Filed: Jan. 29, 2014

(65) Prior Publication Data

US 2015/0209612 A1 Jul. 30, 2015

(51) Int. Cl.

| | |
|---|---|
| ***A63B 22/14*** | (2006.01) |
| ***A63B 22/16*** | (2006.01) |
| ***A63B 22/18*** | (2006.01) |
| ***A63B 22/20*** | (2006.01) |
| ***A63B 21/00*** | (2006.01) |
| ***A63B 21/055*** | (2006.01) |

(52) U.S. Cl.

CPC ..... *A63B 22/18* (2013.01); *A63B 21/0557* (2013.01); *A63B 21/1469* (2013.01); *A63B 22/16* (2013.01); *A63B 22/201* (2013.01)

(58) Field of Classification Search

CPC ..... A63B 22/18; A63B 22/14; A63B 22/16
See application file for complete search history.

(56) References Cited

U.S. PATENT DOCUMENTS

| | | | | |
|---|---|---|---|---|
| 478,166 | A * | 7/1892 | Madsen | 482/146 |
| 5,092,586 | A | 3/1992 | Tuthill et al. | |
| 6,102,345 | A * | 8/2000 | Mori | 248/118.5 |
| 6,421,935 | B1 * | 7/2002 | Bartlett | 36/132 |
| 7,635,325 | B2 | 12/2009 | Chiang et al. | |

* cited by examiner

*Primary Examiner* — Loan H Thanh
*Assistant Examiner* — Rae Fischer
(74) *Attorney, Agent, or Firm* — Charles E. Baxley

(57) ABSTRACT

A twisting exerciser device includes a platform rotatably disposed on a base, a bearing device disposed between the base and the platform, and a curved member having two end studs engageable with the base and the platform for securing the curved member to the platform and the base, and the curved member is contactable with a supporting surface for allowing the user to step on the platform and to conduct a balancing exercise. The platform includes a pivot axle rotatably engaged with the base, and the base includes a number of seats for supporting bearing members which are engaged between the platform and the base for rotatably supporting the platform on the base.

16 Claims, 13 Drawing Sheets

TWISTING EXERCISER DEVICE

BACKGROUND OF THE INVENTION

1. Field of the Invention

The present invention relates to a twisting exerciser, and more particularly to a twisting exerciser device including a structure changeable to different status or configuration for allowing the user to easily and safely and stably operate or conduct various kinds of twisting exercises or operations.

2. Description of the Prior Art

Typical twisting exercisers or mechanisms comprise a platform rotatably supported on a base with a bearing device for allowing the user to rotate the platform relative to the base and to conduct the twisting exercises or operations.

However, normally the bearing device normally include a number of roller or ball bearing members in surface contact with the platform and the base and may have a great friction formed between the platform and the base and may generate a great noise when the platform is rotated relative to the base.

Typical tilting or balancing exercisers comprise a rounded or curved element attached to the bottom of a disk or plate or foot support that may be provided for supporting a user thereon, and for allowing the user to attempt to maintain the disk or plate or foot support in a horizontal position or status, or for allowing the user to conduct the balancing exercises or operations.

For example, U.S. Pat. No. 5,092,586 to Tuthill et al., and U.S. Pat. No. 7,635,325 to Chiang et al. disclose two of the typical disk balancing exercisers or interactive training devices comprising a disk or plate or foot support with threaded hole in its center for threading or engaging with the threaded bolt or screw which includes a hemispherical shoe attached to the bottom portion thereof for pivotally engaging with a supporting surface or ground and for allowing the typical disk balancing exercisers to be operated to maintain the foot support in a horizontal position or status, and for conducting the balancing exercises or operations.

However, the threaded bolt or screw and the foot support may be inclined or tilted a lot relative to the supporting surface or ground, and the users, particularly the elders and the children may feel afraid and may not use or operate the typical disk balancing exercisers, or the tilting operation or the inclination of the movable plate is limited by the supporting member that may not be easily twisted or inclined or tilted relative to the supporting surface or ground, and the movable plate may not freely pivoted or rotated relative to the immovable base to conduct the balancing exercises or operations. Similarly, the elders and the children or the beginners may feel afraid and may not use or operate the typical disk balancing exercisers.

The present invention has arisen to mitigate and/or obviate the afore-described disadvantages of the conventional twisting and/or twisting exercisers.

SUMMARY OF THE INVENTION

The primary objective of the present invention is to provide a twisting exerciser device including a structure changeable to different status or configuration for allowing the user to easily and safely and stably operate or conduct various kinds of twisting exercises or operations.

In accordance with one aspect of the invention, there is provided a twisting exerciser device comprising a base including a hub, and including a plurality of seats formed and provided on the base and arranged around the hub of the base, the seats each including a socket opening formed therein, a platform rotatably disposed on the base for supporting a user thereon, the platform including a pivot axle extended downwardly from a center portion of the platform and rotatably engaged with the hub of the base for rotatably securing the platform to the base, and a bearing device disposed between the base and the platform for allowing the user to rotate the platform relative to the base, the bearing device including a plurality of bearing members engaged in the socket openings of the seats respectively and rotatably attached to the seats with pivot shafts respectively, and the bearing members being supported above and spaced from the base, and being contacted and engaged with the platform for supporting the platform on the base.

The seats each include an inner wall and an outer wall for forming the socket opening of the seat and for confining the bearing member within the socket opening of the seat, and the pivot shafts of the bearing members are engaged with the inner and the outer walls of the seats. The inner and the outer walls of the seats each include an engaging hole formed therein for engaging with the pivot shaft and for anchoring the pivot shaft and thus the bearing member in the seat.

The inner and the outer walls of the seats each include an notch formed in the inner and the outer wall of the seat and communicating with the engaging hole of the seat for guiding the pivot shaft to engage into the engaging hole of the seat, and for allowing the pivot shaft to be stably engaged in the engaging hole of the seat.

One or more curved members each include two end studs engageable with the base and the platform for securing the at least one curved member to the platform and the base, and for securing the platform and the base together with the at least one curved member, and for allowing the at least one curved member to contact with a supporting surface, and for allowing the user to step on the platform and to conduct a balancing exercise.

The base includes two orifices formed therein, and the platform includes two rods extended downwardly from the platform for selectively aligning with the orifices of the base and for selectively engaging with the studs of the curved member when the studs of the curved member are engaged through the orifices of the base. The studs of the curved member each include an aperture formed in the stud for engaging with the rod of the platform and for securing the curved member to the platform and the base.

The platform includes two latch devices for selectively engaging with the studs of the curved member and for detachably securing the curved member to the platform. The latch devices each include a pair of spring biased arms extended downwardly from the platform for selectively engaging with the studs of the curved member.

The platform includes at least three wheel devices detachably attached to the platform and extendible downwardly beyond the base for selectively contacting with the supporting surface and for allowing the platform to be moved on the supporting surface or ground. The platform includes at least three tubes extended downwardly from the platform for selectively engaging with the wheel devices.

The wheel devices each include a bracket, a wheel element attached to the bracket, and a post extended from the bracket for engaging with the tube of the platform. The platform includes at least three catch elements each having a notch formed therein for engaging with the post of the bracket and for detachably retaining the wheel devices to the platform.

A second curved member may further be provided and include two end studs engageable with the base and the platform for securing the second curved member to the platform and the base, and for securing the platform and the base together with the second curved member, and for allowing the second curved member to contact with the supporting surface, and for allowing the user to step on the platform and to conduct the balancing exercise.

The curved member and the second curved member include different curved outer peripheral surfaces to be either in point contact or in two-point contact with the supporting surface when the at least one curved member and the second curved member are disposed side by side in different position.

The platform includes two apertures formed therein for selectively engaging with the studs of the curved member and for detachably securing the curved member to the platform. The platform includes at least one cable device detachably attached to the platform.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
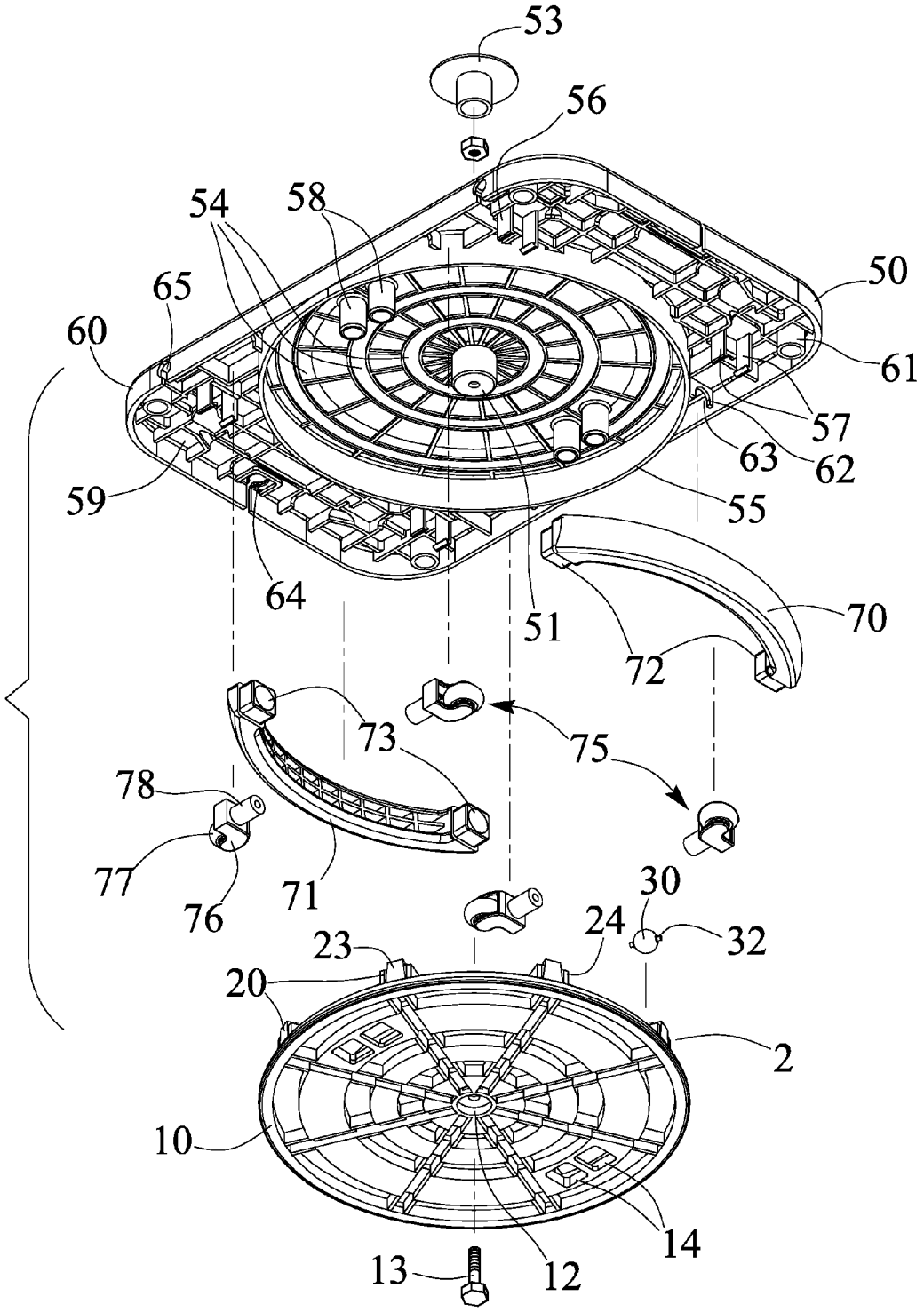
FIG. 1 is an exploded view of a twisting exerciser device in accordance with the present invention.

Referring to the drawings, and initially to FIGS. 1-5, a twisting exerciser device in accordance with the present invention comprises an immovable base 10 for engaging with or for being supported on a supporting surface or ground, the immovable base 10 includes a cylindrical fence or hub 11 formed or provided around a central hole 12, and includes a latch or fastener 13 engaged through the central hole 12 of the immovable base 10, and includes one or more (such as four) orifices 14 formed therein, such as formed through the immovable base 10 and arranged or located oppositely beside the central hole 12 and the hub 11 of the immovable base 10, and the immovable base 10 is provided for supporting a ball or roller bearing device 2 thereon.

For example, the bearing device 2 includes a number of sockets or seats 20 formed or provided on the immovable base 10 and arranged or located around a center portion and/or the central hole 12 and the hub 11 of the immovable base 10, or the immovable base 10 includes the seats 20 formed or provided thereon, and the seats 20 are arranged in one or more (such as three) rows or concentric circles around the central hole 12 and the hub 11 of the immovable base 10, and the seats 20 each include a socket opening 21 formed therein for receiving or engaging with a roller or ball bearing member 30, and each include an inner wall 22 and an outer wall 23 and/or two side walls 24 for forming or defining the socket opening 21 of the seat 20 and for solidly and stably confining or anchoring or retaining or positioning or accommodating the bearing member 30 within the socket opening 21 of the seat 20.

The bearing members 30 each include a through hole 31 formed therein (FIG. 4) for receiving or engaging with a pivot pin or shaft 32, and the inner wall 22 and the outer wall 23 of the seats 20 each include an engaging hole 25, such as a blind engaging hole 25 formed therein (FIGS. 6, 7) for receiving or engaging with the pivot shaft 32 and for solidly and stably anchoring or retaining or positioning the pivot shaft 32 and thus the bearing member 30 in the seat 20 and for allowing the bearing member 30 to be supported above and spaced from the immovable base 10 (FIGS. 3, 6, 7), and an opening or notch 26 formed in the upper portion of the inner wall 22 and the outer wall 23 of the seat 20 and communicating with the engaging hole 25 of the seat 20 for guiding the pivot shaft 32 to easily engage into the engaging hole 25 of the seat 20, and for allowing the pivot shaft 32 to be solidly and stably anchored or retained or positioned in the engaging hole 25 of the seat 20.

The notch 26 of the seat 20 includes a narrower lower portion having an inner diameter or width smaller than the inner diameter of the engaging hole 25 of the seat 20 for forming or defining a catch 27 between the notch 26 and the engaging hole 25 of the seat 20 (FIG. 7) and for contacting or engaging with the pivot shaft 32 and for solidly and stably anchoring or retaining or positioning the pivot shaft 32 in the engaging hole 25 of the seat 20 and for preventing the pivot shaft 32 from being disengaged or separated from the seat 20. One or more (such as two) gaskets or cylindrical members or sleeves or barrels 33 are further provided and engaged onto the pivot shaft 32 and engaged between the pivot shaft 32 and the bearing member 30 and also engaged between the inner and the outer walls 22, 23 of the seat 20 (FIG. 6) for allowing the bearing member 30 to freely pivot or rotate relative to the pivot shaft 32 and the seat 20 of the bearing device 2.

Figure 9:
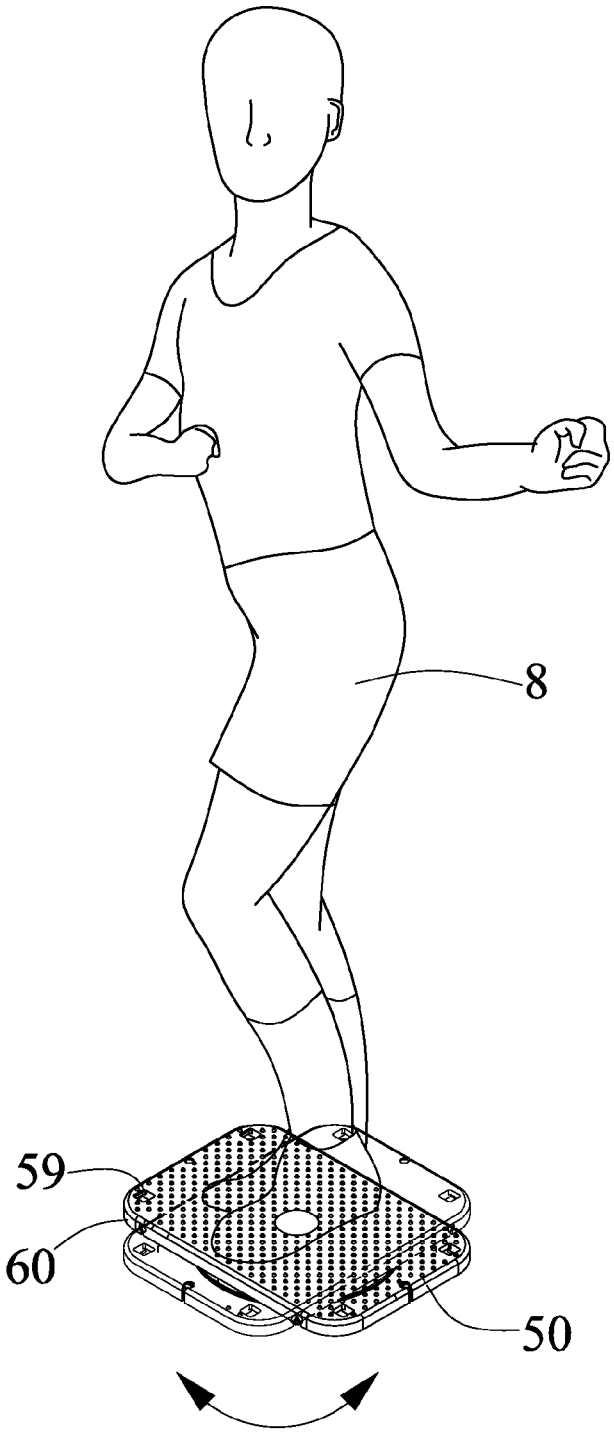
FIG. 9 is an upper perspective view illustrating the operation of the twisting exerciser device.
Figure 11:
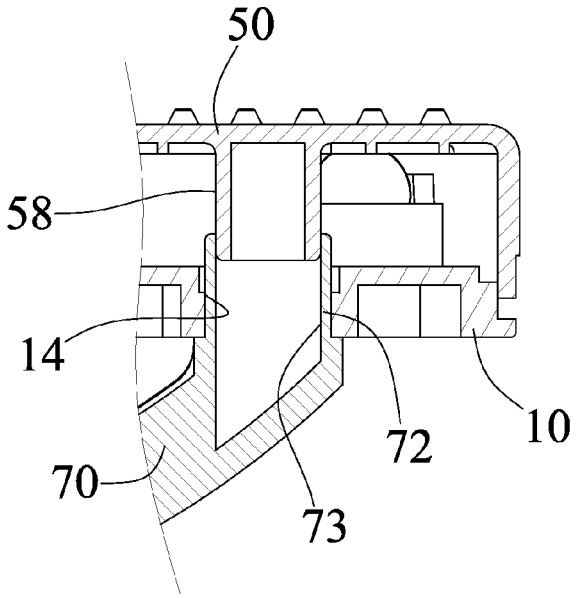
FIG. 11 is an enlarged partial cross sectional view of the twisting exerciser of the twisting exerciser device, taken along lines 11-11 of FIG. 10.
Figure 12:
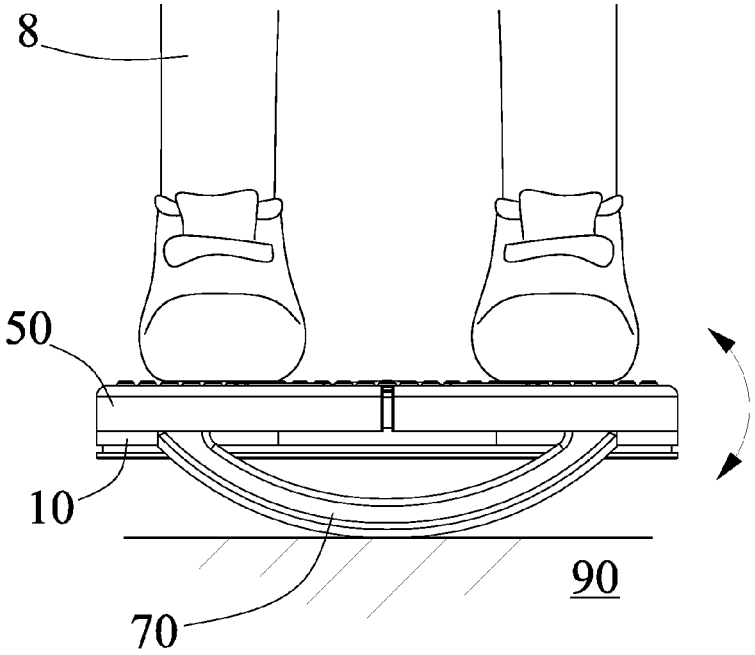
FIGS. 12, 13, 14 are front plan schematic views illustrating the operation of the twisting exerciser device.

A foot support or board or plate or platform 50 is to be pivotally or rotatably disposed or attached or mounted or secured on the immovable base 10 for supporting the user 8 thereon (FIG. 9) and for allowing the user 8 to pivot or rotate the platform 50 relative to the immovable base 10 and for allowing the user 8 to actuate or operate or conduct the twisting or rotating exercises or operations. For example, the platform 50 includes a hub or projection or pivot axle 51 extended downwardly from the middle or center portion of the platform 50 and pivotally or rotatably disposed or engaged into the hub 11 of the immovable base 10 (FIG. 3), and the fastener 13 is engaged with the pivot axle 51 for pivotally or rotatably securing or coupling the pivot axle 51 of the platform 50 to the immovable base 10. The platform 50 includes a cavity 52 formed in the upper portion of the pivot axle 51 of the platform 50 for receiving or engaging with a cap 53.

Figure 3:
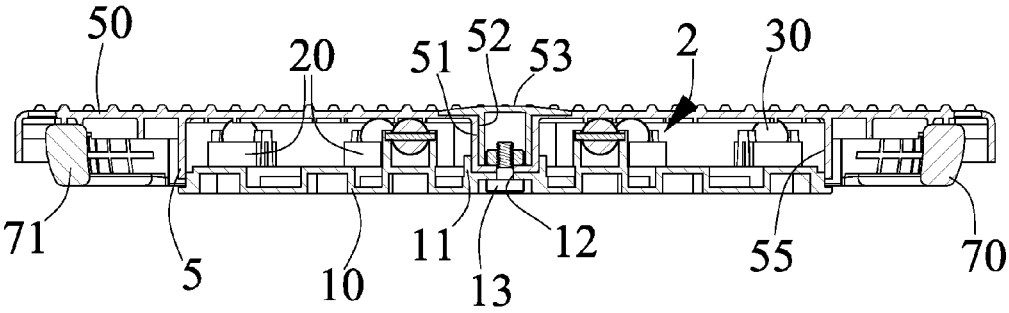
FIG. 3 is a cross sectional view of the twisting exerciser of the twisting exerciser device, taken along lines 3-3 of FIG. 2.
Figure 4:
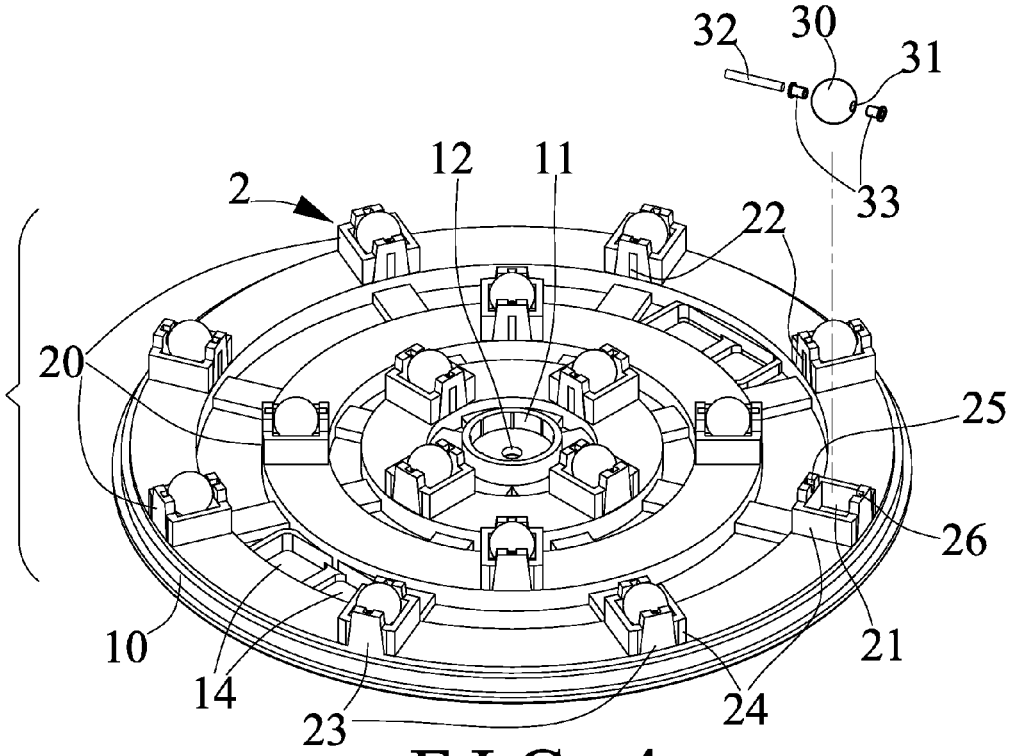
FIG. 4 is a partial exploded view of the twisting exerciser of the twisting exerciser device.
Figure 5:
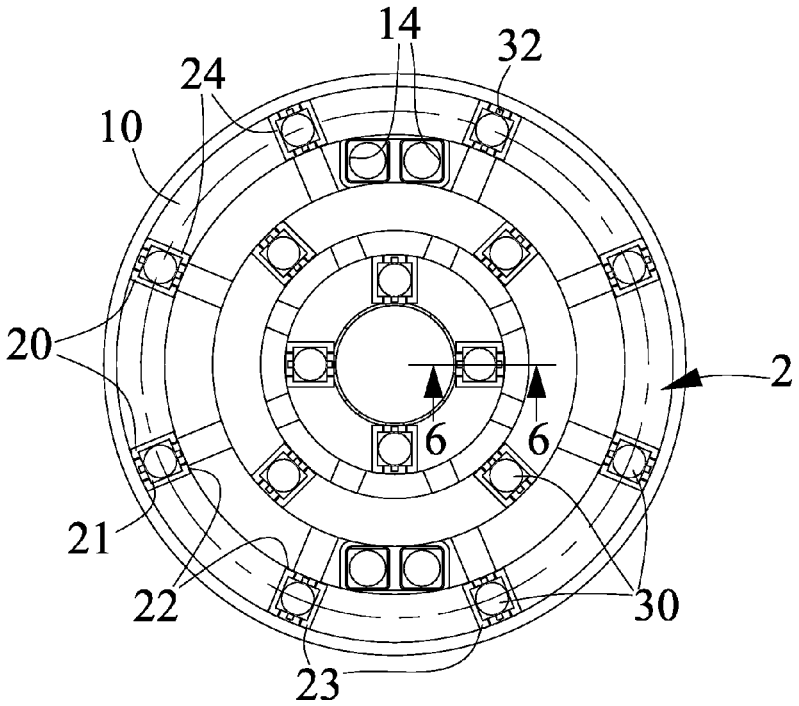
FIG. 5 is a top plan schematic view illustrating a supporting or immovable base of the twisting exerciser device.
Figure 6:
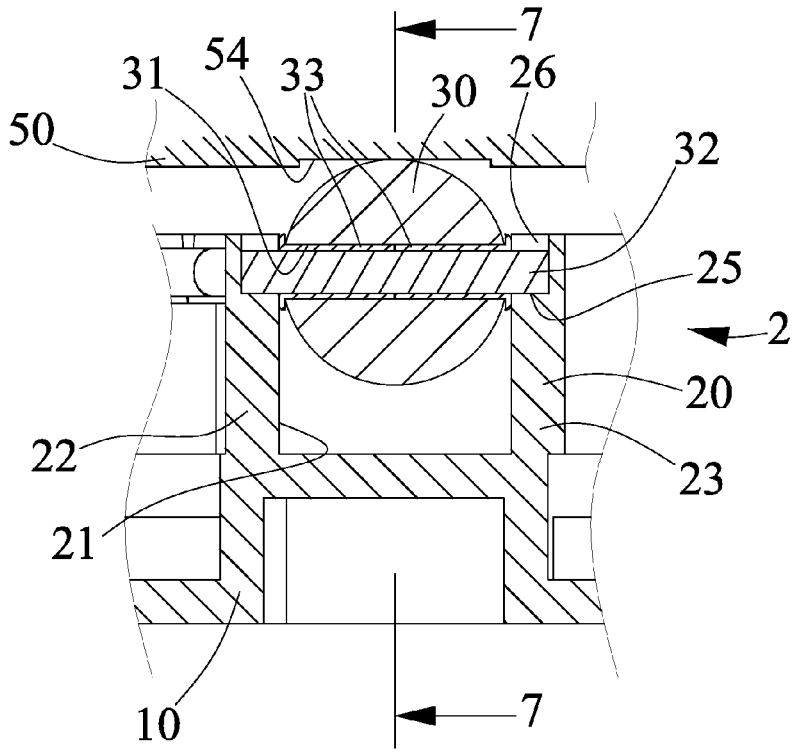
FIG. 6 is an enlarged partial cross sectional view of the twisting exerciser of the twisting exerciser device, taken along lines 6-6 of FIG. 5.
Figure 7:
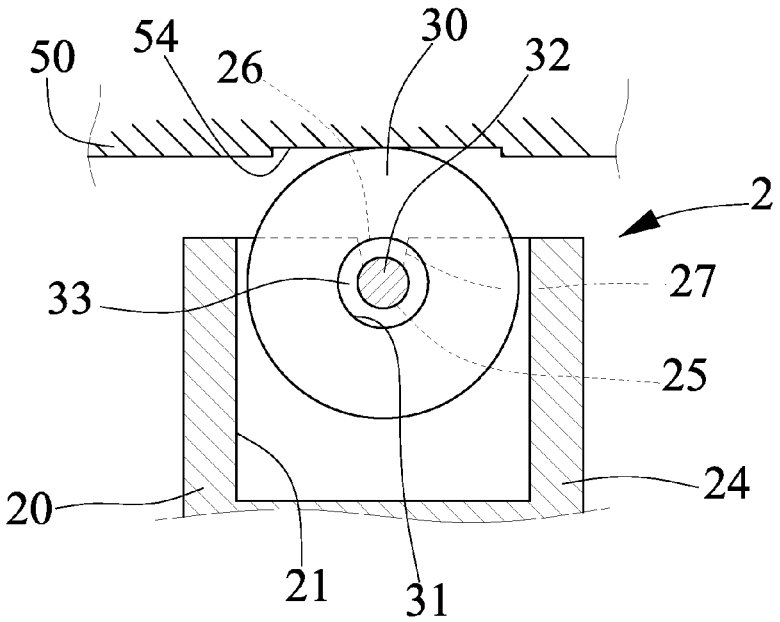
FIG. 7 is a partial cross sectional view of the twisting exerciser of the twisting exerciser device, taken along lines 7-7 of FIG. 6.

As best shown in FIGS. 3 and 6-7, the bearing members 30 are partially extended upwardly and outwardly of the seats 20 and point contacted or engaged with the platform 50 such that the bearing device 2 may be disposed or arranged between the immovable base 10 and the platform 50 for smoothly and stably supporting the platform 50 on the immovable base 10, it is preferable, but not necessary that the platform 50 includes one or more (such as three) circular and concentric depressions or tracks 54 formed in the bottom portion of the platform 50 for receiving or engaging with the bearing members 30 and for guiding the bearing members 30 to smoothly and stably move relative to the platform 50, and thus for guiding the platform 50 to smoothly and stably pivot or rotate relative to the immovable base 10. The platform 50 further includes a circular or peripheral wall or fence 55 extended downwardly therefrom and having an outer diameter substantially equal to or slightly greater than that of the immovable base 10 for covering or shielding the immovable base 10 (FIG. 3).

Figure 8:
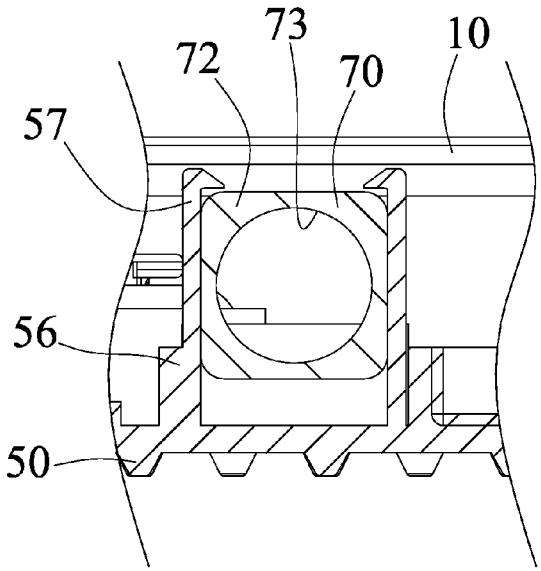
FIG. 8 is a partial cross sectional view of the twisting exerciser of the twisting exerciser device, taken along lines 8-8 of FIG. 2.

The platform 50 further includes one or more (such as four) latch devices 56 extended downwardly therefrom and each having a pair of spring biased projections or arms 57 extended downwardly from the platform 50 (FIGS. 1, 8), and includes one or more (such as four) studs or posts or pins or rods 58 also extended downwardly from the platform 50 (FIG. 1) for selectively aligning with the orifices 14 of the immovable base 10 (FIG. 2), and one or more (such as two) handles or curved arms or arch members 70, 71 each include two end members or studs 72 extended outwardly therefrom and parallel to each other for selectively engaging with the latch devices 56 (FIGS. 2, 8) and for detachably or releasably or removably attaching or mounting or securing or retaining to the platform 50, and an aperture 73 formed in each of the studs 72 (FIGS. 1, 8).

Figure 2:
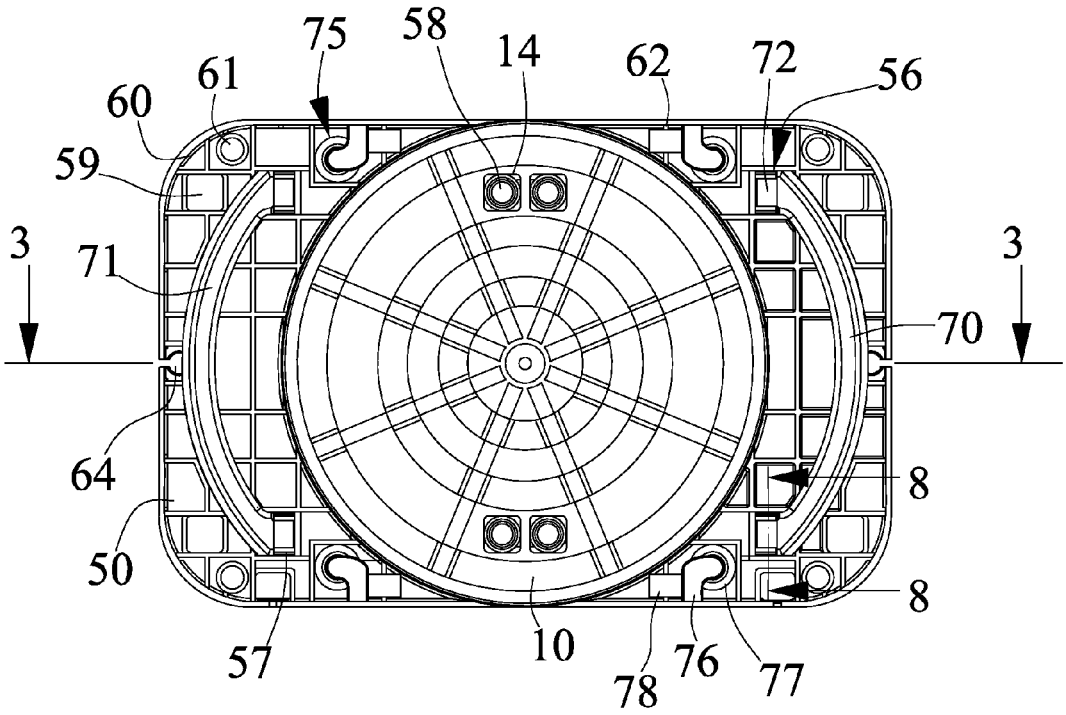
FIG. 2 is a bottom plan schematic view of the twisting exerciser device.

As shown in FIGS. 2 and 3, the end studs 72 of the curved members 70, 71 may be detachably or releasably attached to or engaged with the latch devices 56 for allowing the curved members 70, 71 to be retained and stored in the bottom of the platform 50, as shown in FIGS. 2 and 10-16, when the rods 58 of the platform 50 are selectively aligned with the orifices 14 of the immovable base 10 (FIG. 2), the end studs 72 of the curved members 70, 71 may be selectively engaged into and through the orifices 14 of the immovable base 10 (FIG. 11), and to engage the rods 58 of the platform 50 into the apertures 73 of the studs 72, and to attach or mount the curved members 70, 71 to the platform 50 and the immovable base 10, at this moment, the platform 50 is solidly and stably anchored and secured to the immovable base 10 with the curved members 70, 71 and may not be pivoted or rotated relative to the immovable base 10.

Figure 13:
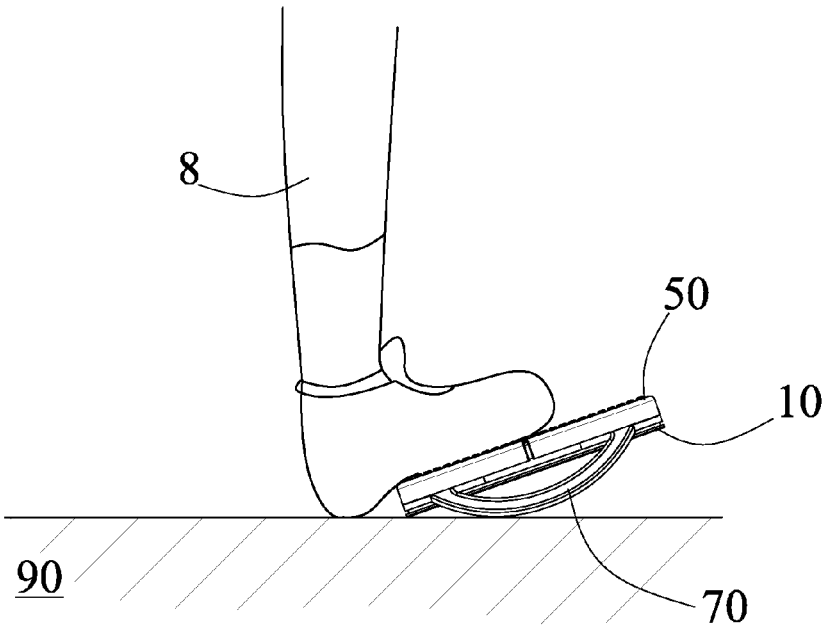
Figure 14:
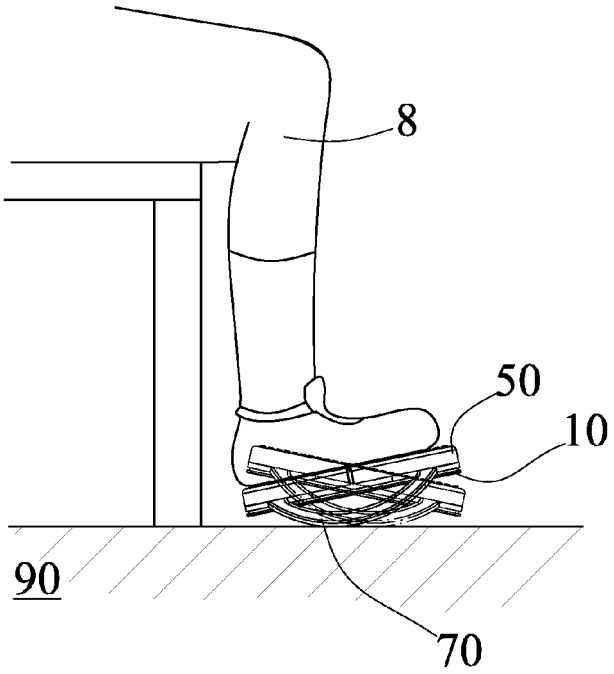
Figure 15:
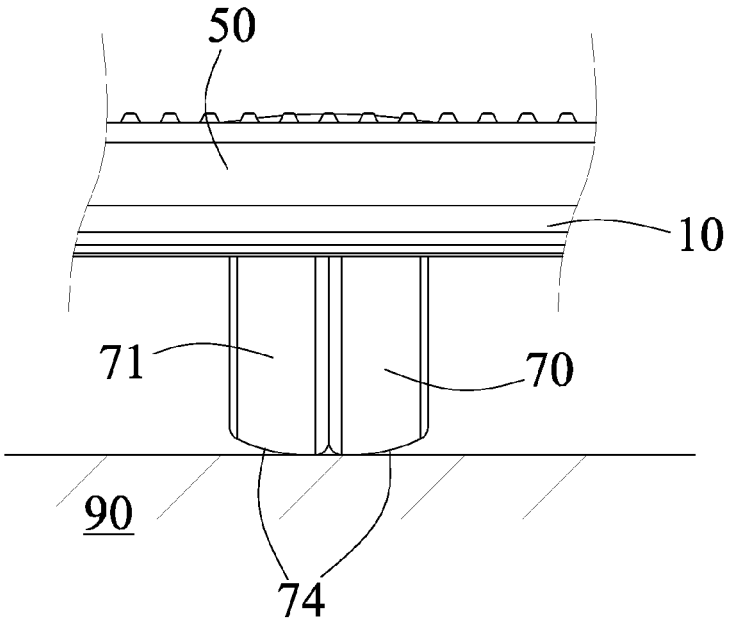
FIGS. 15, 16 are partial side plan schematic views illustrating the operation of the twisting exerciser device.
Figure 16:
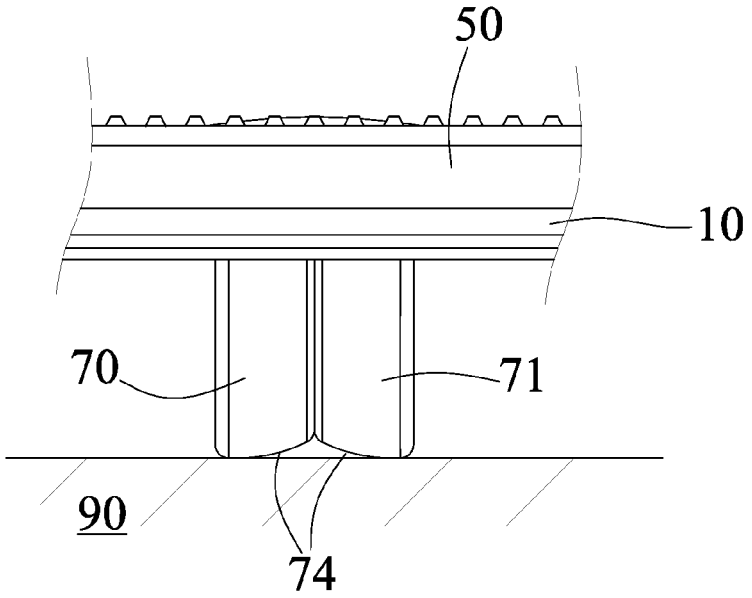

In operation, as shown in FIGS. 12-16, the curved members 70, 71 may be contacted or engaged with the supporting surface or ground 90, and the user 8 may step on the platform 50 to operate or conduct the twisting exercises or operations (FIG. 12), or to train the lower muscle groups of the user 8 (FIGS. 13-14). As shown in FIGS. 15-16, the curved members 70, 71 may include different curved outer peripheral surfaces 74 formed or provided thereon, and the curved members 70, 71 are preferably disposed or arranged side by side and may be changed relative to each other to the other position or location for allowing the curved outer peripheral surfaces 74 of the curved members 70, 71 to be in point contact (FIG. 15) or in two-point contact (FIG. 16) with the supporting surface or ground 90.

Figure 10:
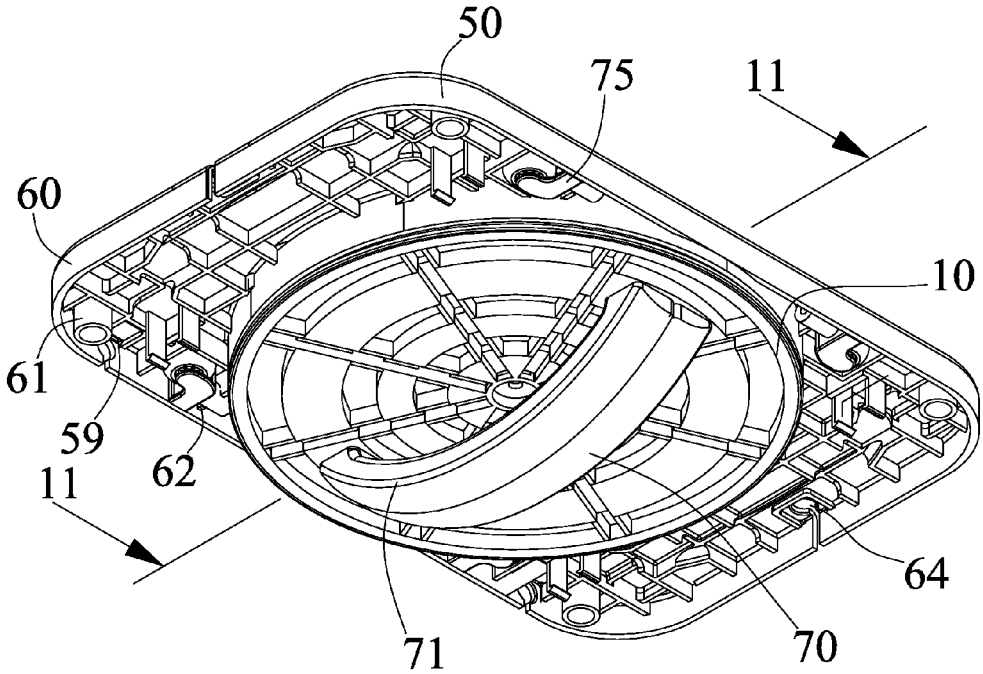
FIG. 10 is a bottom perspective view illustrating the operation of the twisting exerciser device.
Figure 17:
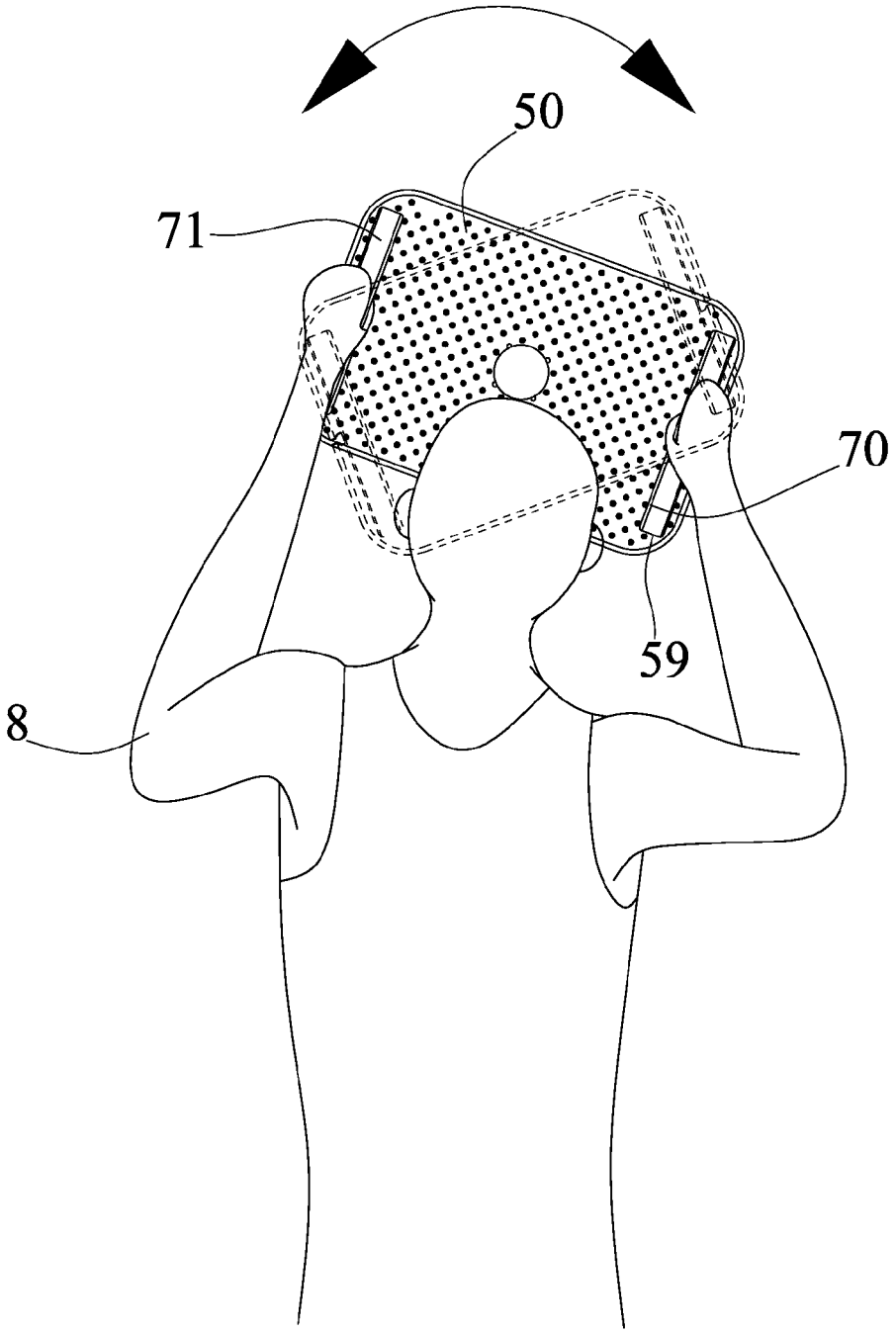
FIG. 17 is a top plan schematic view illustrating the operation of the twisting exerciser device.
Figure 20:
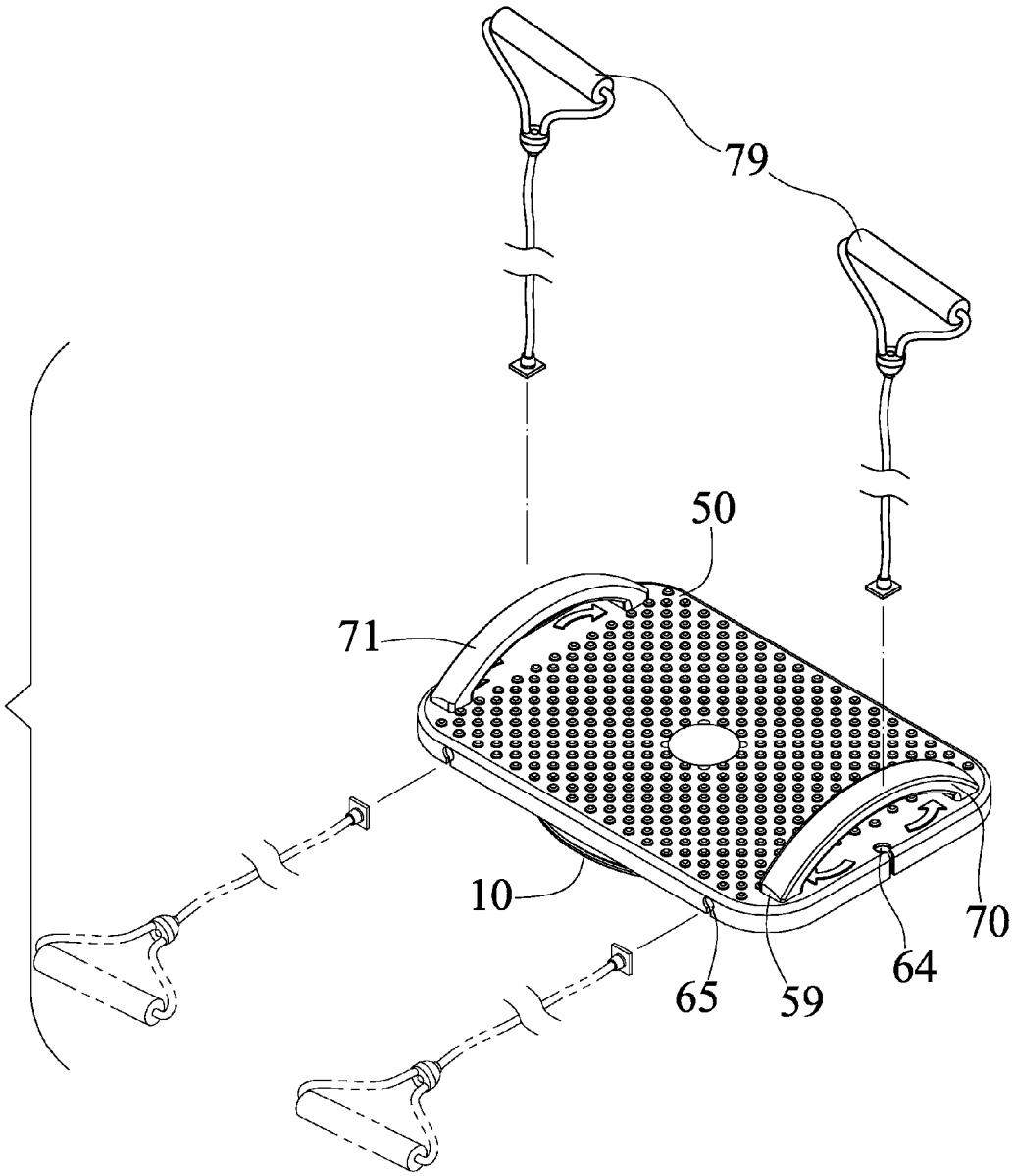
FIG. 20 is a partial exploded view illustrating the other arrangement of the twisting exerciser device.

As shown in FIGS. 1-2 and 9-10, the platform 50 may further include one or more (such as four) apertures 59 formed in the corner areas 60 thereof, and the end studs 72 of the curved members 70, 71 may be selectively engaged into and through the apertures 59 of the platform 50 (FIGS. 17, 20), at this moment, the platform 50 is not anchored and secured to the immovable base 10 and may be pivoted or rotated relative to the immovable base 10. In operation, as shown in FIG. 17, the user 8 may face down and may hold and grasp the curved members 70, 71 to rotate the platform 50 relative to the immovable base 10 and to train the upper muscle groups of the user 8, at this moment, the immovable base 10 may be contacted or engaged with the supporting surface or ground 90. The platform 50 may further include three or more (such as four) studs or pins or rods or posts or tubes 61 extended downwardly from the corner areas 60 of the platform 50 (FIGS. 1-2, 10) for selectively attaching or engaging with wheel devices 75 (FIGS. 1-2, 10).

The platform 50 further includes three or more (such as four) catch elements 62 extended downwardly therefrom (FIGS. 1-2) and each having a notch 63 formed therein (FIG. 1) for selectively receiving or engaging with the wheel devices 75 and for detachably or releasably or removably attaching or mounting or securing or retaining the wheel devices 75 to the platform 50 and for allowing the wheel devices 75 to be retained and stored in the bottom of the platform 50, as shown in FIGS. 2 and 10, and the wheel devices 75 each include a frame or bracket 76 for attaching or mounting or securing a wheel element 77, and a stud or pin or rod or post 78 extended from the bracket 76 for selectively engaging with the catch elements 62 and for detachably anchoring the wheel devices 75 to the platform 50.

Figure 18:
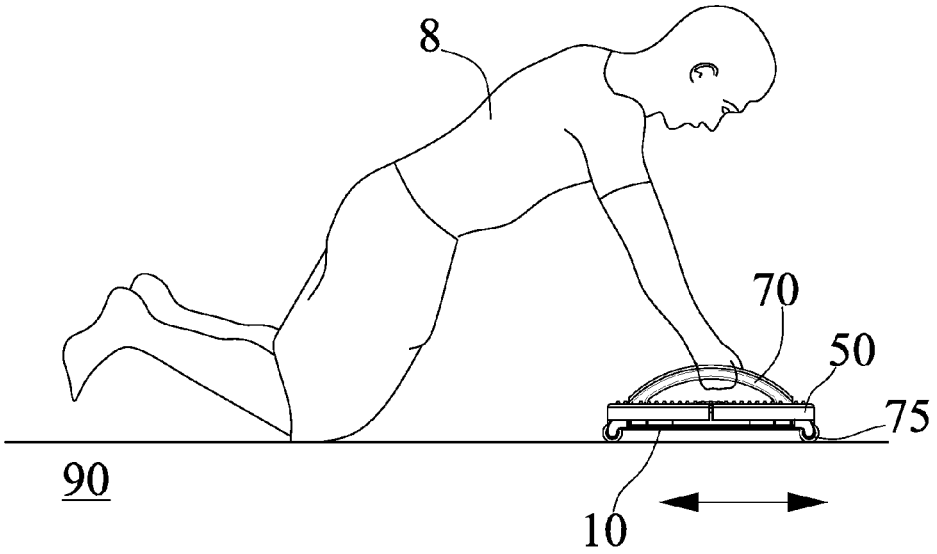
FIGS. 18, 19 are side plan schematic views illustrating the operation of the twisting exerciser device.
Figure 19:
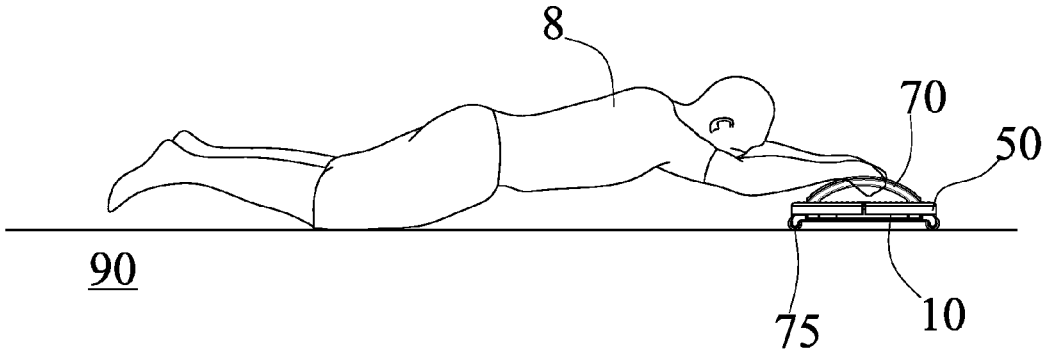
Figure 21:
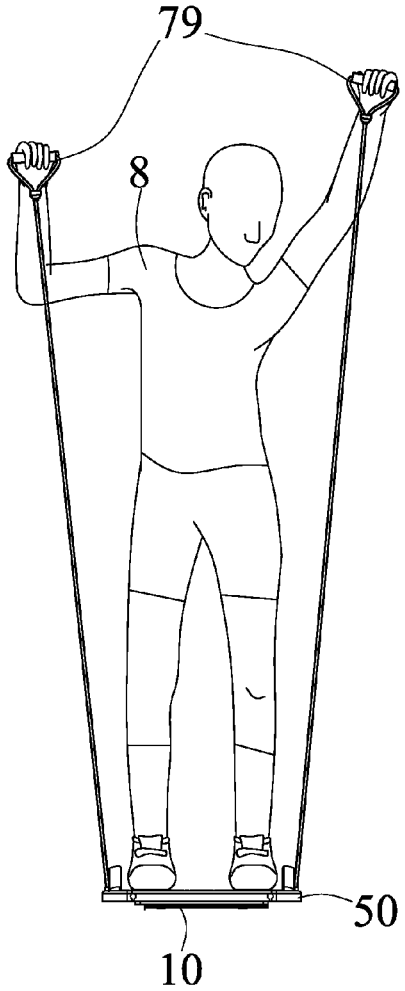
FIG. 21 is a front plan schematic view illustrating the operation of the twisting exerciser device.
Figure 22:
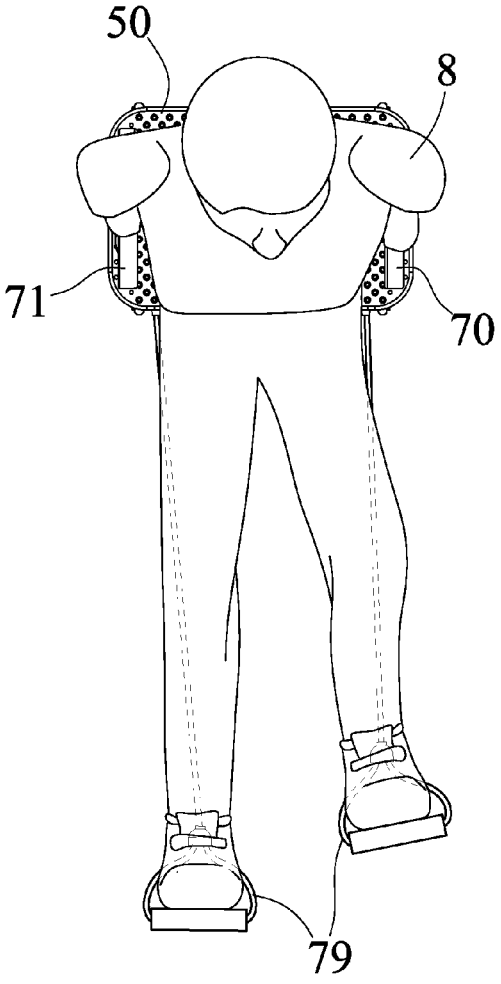
FIG. 22 is a top plan schematic view illustrating the operation of the twisting exerciser device.

In operation, the posts 78 of the wheel devices 75 may be selectively engaged with the tubes 61 of the platform 50, and the wheel elements 77 may be extended downwardly beyond the immovable base 10 (FIGS. 18-19) for selectively contacting or engaging with the supporting surface or ground 90, and the user 8 may face down and may hold and grasp the curved members 70, 71 to move the platform 50 relative to the supporting surface or ground 90 and to train the middle muscle groups or the abdominal portion of the user 8. The platform 50 may further include one or more (such as two) key holes 64 formed therein (FIGS. 1-2, 10, 20) for detachably or releasably or removably attaching or mounting or securing or retaining the cable devices 79 and for allowing the user 8 to train the upper muscle groups of the user 8 (FIG. 21), and may further include one or more (such as two) further key holes 65 formed therein (FIGS. 1, 20) for detachably or releasably or removably attaching or mounting or securing or retaining the cable devices 79 and for allowing the user 8 to train the lower muscle groups of the user 8 (FIG. 22).

Accordingly, the twisting exerciser device in accordance with the present invention includes a structure changeable to different status or configuration for allowing the user to easily and safely and stably operate or conduct various kinds of twisting exercises or operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A twisting exerciser device comprising: a base including a hub, and a plurality of seats formed and provided on the base and arranged around the hub of the base, the seats each including a socket opening formed therein, a platform rotatably disposed on the base for supporting a user thereon, the platform including a pivot axle extended downwardly from a center portion of the platform and rotatably engaged with the hub of the base for rotatably securing the platform to the base, and a bearing device disposed between the base and the platform for allowing the user to rotate the platform relative to the base, the bearing device including a plurality of bearing members engaged in the socket openings of the seats, respectively, and rotatably disposed in the seats, and the bearing members being contacted and engaged with the platform for supporting the platform on the base; and a curved member including two end studs positioned at the end of the curved member and engaged with the base and the platform for securing the curved member to the platform and the base to allow the platform and the base to rock back and forth relative to a horizontal surface upon which the curved member rests, and to allow the user to step on the platform to conduct a balancing exercise.

2. The twisting exerciser device as claimed in claim 1, wherein said seats each include an inner wall and an outer wall for forming said socket opening of said seat and for confining said bearing member within said socket opening of said seat, and the pivot shafts provided for each of the bearing members are engaged with said inner and said outer walls of said seats.

3. The twisting exerciser device as claimed in claim 2, wherein said inner and said outer walls of said seats each include an engaging hole formed therein for engaging with and anchoring the respective pivot shaft and thus said bearing member in said seat.

4. The twisting exerciser device as claimed in claim 3, wherein said inner and said outer walls of said seats each include an notch formed in said inner and said outer wall of said seat and communicating with said engaging hole of said seat for guiding the respective pivot shaft to engage into said engaging hole of said seat, and to allow said pivot shaft to be stably engaged in said engaging hole of said seat.

5. The twisting exerciser device as claimed in claim 1, wherein the base includes two orifices formed therein, and the platform includes two rods extended downwardly from the platform for selectively aligning with the orifices of the base and for selectively engaging with the end studs of the curved member when the end studs of the curved member are engaged through the orifices of the base.

6. The twisting exerciser device as claimed in claim 5, wherein the end studs of the curved member each include an aperture formed in the end stud for engaging with the rod of the platform.

7. The twisting exerciser device as claimed in claim 1, wherein the platform includes two latch devices for selectively engaging with the end studs of the curved member and for detachably securing the curved member to the platform.

8. The twisting exerciser device as claimed in claim 7, wherein the latch devices each include a pair of spring biased arms extended downwardly from the platform for selectively engaging with the end studs of the curved member.

9. The twisting exerciser device as claimed in claim 1, wherein said platform includes at least three wheel devices detachably attached to said platform and extendible downwardly beyond said base for selectively contacting with said supporting surface.

10. The twisting exerciser device as claimed in claim 9, wherein said platform includes at least three tubes extended downwardly from said platform for selectively engaging with said at least three wheel devices.

11. The twisting exerciser device as claimed in claim 10, wherein said at least three wheel devices each include a bracket, a wheel element attached to said bracket, and a post extended from said bracket for engaging with said tube of said platform.

12. The twisting exerciser device as claimed in claim 11, wherein said platform includes at least three catch elements each having a notch formed therein for engaging with said post of said bracket and for detachably retaining said at least three wheel devices to said platform.

13. The twisting exerciser device as claimed in claim 1, wherein the platform includes two apertures formed therein for selectively engaging with the end studs of the curved member and for detachably securing the curved member to the platform.

14. The twisting exerciser device as claimed in claim 1 further comprising a second curved member including two end studs positioned at the end of the curved member and engaged with the base and the platform to secure the second curved member to the platform and the base, to allow the second curved member to contact with the supporting surface, and to allow the user to step on the platform and to conduct the balancing exercise.

15. The twisting exerciser device as claimed in claim 14, wherein the first and second curved members are configured to allow either one or both curved members to contact the support surface during use.

16. The twisting exerciser device as claimed in claim 1, wherein said platform includes a cable device detachably attached to said platform.

* * * * *